US005480204A

United States Patent [19]

Erickson

[11] Patent Number: 5,480,204

[45] Date of Patent: Jan. 2, 1996

[54] CARRIER FOR CONTAINERS

[76] Inventor: Richard W. Erickson, #6 - 675 Brea Canyon Rd., Walnut, Calif. 91789

[21] Appl. No.: 304,357

[22] Filed: Sep. 12, 1994

[51] Int. Cl.[6] ..... B65D 71/00

[52] U.S. Cl. ..... 294/87.2; 294/159; 206/151

[58] Field of Search ..... 294/27.1, 31.2, 294/87.2–87.28, 159, 167; 206/139, 143, 145–151, 162, 199, 200; 215/100 A

[56] References Cited

U.S. PATENT DOCUMENTS

| | | | |
|---|---|---|---|
| 2,963,193 | 12/1960 | Arthur | 206/139 X |
| 3,003,805 | 10/1961 | Glazer | 206/147 X |
| 3,261,498 | 7/1966 | Erickson . | |
| 3,321,076 | 5/1967 | Poupitch | 294/87.2 X |
| 3,421,790 | 1/1969 | Carson . | |
| 3,463,536 | 8/1969 | Updegraff et al. . | |
| 4,090,729 | 5/1978 | Erickson . | |
| 4,093,295 | 6/1978 | Erickson . | |
| 4,159,841 | 7/1979 | Calvert . | |
| 4,231,605 | 11/1980 | Newman . | |
| 4,235,468 | 11/1980 | Erickson . | |
| 4,247,142 | 1/1981 | Erickson . | |
| 4,249,766 | 2/1981 | Erickson | 294/87.2 |
| 4,453,630 | 6/1984 | Helms et al. . | |
| 4,471,987 | 9/1984 | Erickson . | |
| 4,523,677 | 6/1985 | Schürmann | 294/87.2 X |
| 4,911,289 | 3/1990 | Bird . | |
| 4,917,428 | 4/1990 | Sola | 206/145 X |
| 5,096,246 | 3/1992 | Cnare | 294/87.2 |
| 5,306,060 | 4/1994 | Borg | 294/87.2 |
| 5,346,271 | 9/1994 | Erickson | 294/87.2 |

*Primary Examiner*—Dean Kramer
*Attorney, Agent, or Firm*—Boniard I. Brown

[57] ABSTRACT

A carrier for necked containers has a pair of split collars with conically tapered container neck-engaging fingers disposed at a 30–45 degree conical taper angle relative to planes transverse to the collar axes for engagement over the container necks to positions wherein the collar fingers are disposed below and in vertical supporting engagment with the container neck rings, and a bridge section joining the collars and forming a handgrip by which the carrier may be held in a normal position wherein the weight of supported containers bends the ends of the bridge section downwardly. The bridge section has upstanding ribs at its upper side which reinforce the bridge section against excessive bending and form upwardly opening cavities having drain holes for draining liquid from the cavities.

6 Claims, 2 Drawing Sheets

CARRIER FOR CONTAINERS

BACKGROUND OF THE INVENTION

FIELD OF THE INVENTION

This invention relates generally to container carriers and more particularly to a carrier for relatively large containers such as half-gallon bottles and gallon jugs.

REFERENCE TO COPENDING APPLICATION

Reference is made to my application Ser. No. 08/022,142 entitled CARRIER FOR CONTAINERS now U.S. Pat. No. 5,346,271.

DISCUSSION OF THE PRIOR ART

Containers of the kind with which this invention is concerned are widely used to package a variety of substances for commercial sale. For example, beverages including milk, sodas, and water are now commonly sold in half gallon bottles and gallon jugs. These containers are commonly fabricated from plastic or glass and have an upper reduced neck through which the containers are initially filled and the container contents is subsequently dispensed by the user. This neck is normally closed by a removable cap and has a circumferential shoulder located just below the cap which is referred to as a neck ring or chime.

A variety of carriers have been devised for holding such containers, in some cases two or more containers arranged side by side. Examples of such container carriers are disclosed in the following patents:

U.S. Pat. No. 3,261,498 dated Jul. 19, 1966 to Erickson discloses a bottle tray.

U.S. Pat. No. 3,421,790 dated Jan. 14, 1969, to Carson discloses a folding bottle carrier.

U.S. Pat. No. 3,463,536 dated Aug. 26, 1969, to Updegraff et al discloses a container with a flexible handle.

U.S. Pat. No. 4,090,729 dated May 23, 1978, to Erickson discloses a bottle carrier having a split collar for holding a single bottle by the neck.

U.S. Pat. No. 4,093,295 dated Jun. 6, 1978, to Erickson discloses a bottle carrier having a plurality of split collars for holding a plurality of bottles side by side by their necks.

U.S. Pat. No. 4,159,841 dated Jul. 3, 1979, to Calvert discloses a bottle carrier having a central bridge section with split collars at its ends for holding a pair of bottles side by side by their necks.

U.S. Pat. No. 4,231,605 dated Nov. 4, 1980, to Newman discloses a carrier assembly for multi-pack containers.

U.S. Pat. No. 4,235,468, dated Nov. 25, 1980, to Erickson discloses a bottle carrier having multiple collars for holding bottles by their necks.

U.S. Pat. No. 4,247,142 dated Jan. 27, 1981, to Erickson discloses a bottle carrier having multiple openings bounded by radial fingers for holding bottles by their necks.

U.S. Pat. No. 4,249,766 dated February 1981, to Erickson discloses a bottle separating and connecting band for holding bottles by their necks and separating the bottles.

U.S. Pat. No. 4,453,630 dated Jun. 12, 1984, to Helms et al discloses a bottle carrier in the form of a shell having openings bounded by flexible fingers for holding bottles by their necks.

U.S. Pat. No. 4,471,987 dated Sep. 18, 1984, to Erickson discloses a bottle carrier having multiple split collar portions for holding bottles by their necks.

U.S. Pat. No. 4,523,677 dated Jun. 18, 1985, to Schurmann discloses a bottle carrier having multiple split collar portions for holding collars by their necks.

U.S. Pat. No. 4,911,289 dated Mar. 27, 1990, to Bird discloses a flat sheet bottle carrier having holes for holding the bottles by their necks.

U.S. Pat. No. 5,306,060 dated Apr. 26, 1994, to Borg discloses a carrier strap having a central bridge portion and split collars at the ends of the bridge portion for holding a pair of jugs by their necks.

My above referenced copending application discloses a container carrier having a central bridge section forming a handle for holding the carrier and collars pivotally mounted on the ends of the bridge section for holding containers by their neck in such a way as to prevent inadvertent release of the containers from the carrier.

BRIEF DESCRIPTION OF THE INVENTION

This invention provides an improved carrier for containers of the kind described. In its preferred form, the improved carrier has certain features in common with the container carrier disclosed in my copending application.

According to one important aspect of this invention, the improved container carrier is injection molded from a suitable plastic, such as polypropolene, and has a plurality of container holders for releasably holding containers by their necks joined by an intervening bridge section having ends joined to the container holders. This bridge section serves as a handle or grip section which may be grasped in one hand to carry the container package consisting of the carrier and the containers. The carrier has normally upper and lower sides, and the weight of containers supported on the carrier tends to bend the ends of the bridge section downwardly relative to the center of the bridge section when the container package is carried. According to this invention, the underside of the bridge section is made relatively flat and smooth, and the upper side of the bridge section has upstanding reinforcing rib means which reinforce the bridge section against excessive bending under the weight of the supported containers. This carrier construction provides a three-fold advantage, namely enhancement of handgrip comfort, compensation for carrier warpage during molding, and stressing of the carrier reinforcing rib means in tension which is their most effective stress mode.

The upper reinforcing rib means of the carrier bridge section provide upwardly opening cavities in the carrier which are prone to filling with liquid either at the bottling plant where the containers are filled and capped and the carriers are assembled on the containers or later due to leakage of the filled containers during stacking and handling of the containers. Accumulations of liquid within these cavities is very undesireable and would seriously affect the marketability of the container packages, particularly when the liquid is one, such as milk, which will breed bacteria and/or is sticky, unsightly, or corrosive. According to another important aspect of the draining liquid from these carrier cavities so as to eliminate the possibility of such liquid accumulation within the cavities.

Each container holder of the improved container carrier comprises a collar including a collar ring for engagement over the neck of a container to a position just below the container neck ring and resiliently flexible container neck-engaging elements about the inner circumference of the collar ring. These container neck-engaging elements project inwardly toward the collar ring axis and upwardly toward the upper side of the collar ring at an oblique angle relative to a plane transverse to the axis for engaging the under side of the container neck ring to vertically support the container in the collar. According to a further aspect of this invention, the collar ring is a resiliently flexible band, and included angle between the container neck-engaging elements and a plane transverse to the collar ring axis is in the range of 30–45 degrees. This collar construction facilitates placement of the collar over and removal of the collar from a container neck and increases the container weight supporting capability of the collar without the neccessity of providing reinforcing ribs on the elements.

Other features of the carrier reside in a novel reinforcing rib arrangement for the reinforcing the bridge section of the carrier in such a way as to provide the bridge section with optium resistance to bending and in a novel channel configuration of certain portions of the carrier which result in a substantial saving of material and cost. In the presently preferred carrier embodiment described herein, the container holders are pivotally mounted on the ends of the carier bridge section in the same manner as the container holders of the container carrier described in my earlier mentioned copending application.

DESCRIPTION OF THE PREFERRED EMBODIMENT

Figure 1:
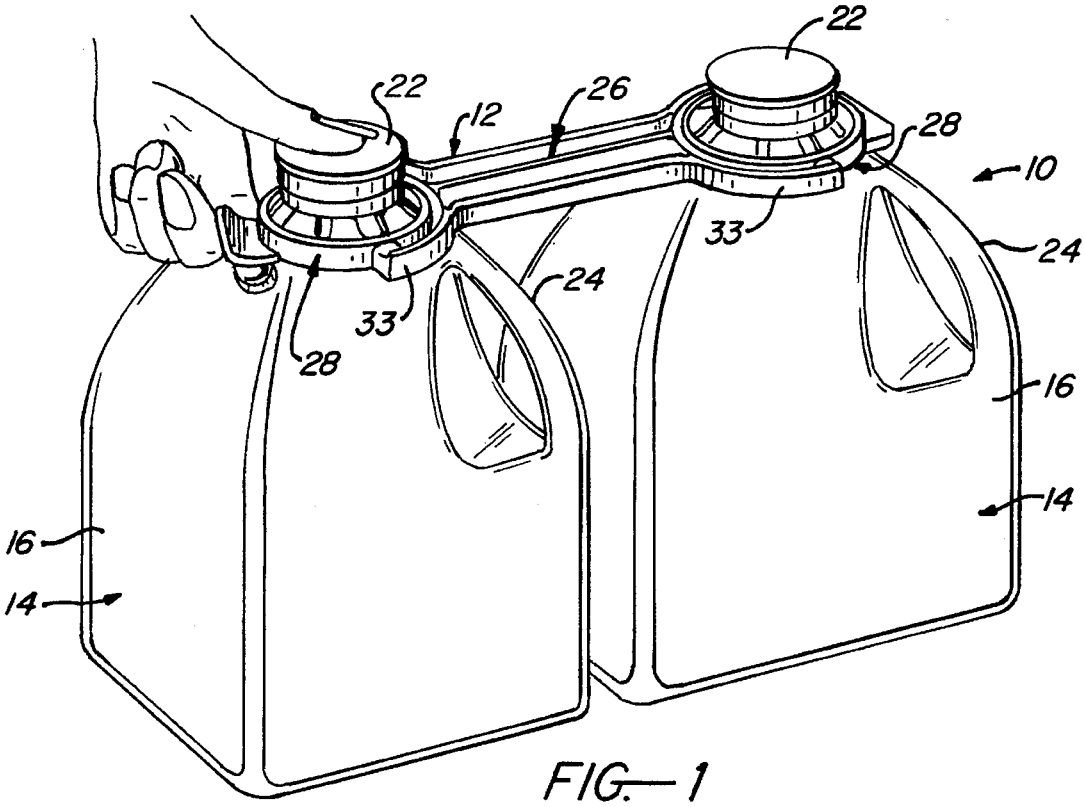
FIG. 1 illustrates a presently preferred container carrier according to the invention assembled on a pair of containers such as gallon milk jugs to form a container package.
Figure 2:
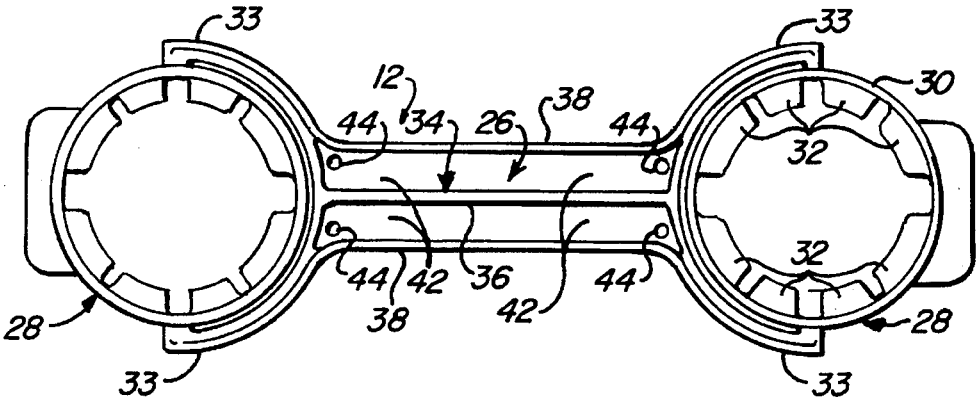
FIG. 2 is an enlarged top plan view of the container carrier in FIG. 1.

Turning now to these drawings, there is illustrated a container package 10 including an improved container carrier 12 according to this invention assembled on a pair of relatively large containers 14 of the kind mentioned earlier. In this case, the containers 14 are gallon jugs which are commonly fabricated from plastic by a blow molding process and used to contain milk, water, chemicals, and other substances. Each container 14 has a lower enlarged body 16 and an upper reduced neck 18 circumferentially surrounded by an annular shoulder 20 commonly referred to as a neck ring or chime. The container 14 is initially filled and subsequently emptied through its neck 18, and the neck is normally closed by a removable cap 22. Each container has an integral handle 24 by which the container may be held after separation from the carrier 12.

Container carrier 12 is similar to that of my earlier mentioned copending application in that carrier 12 comprises a carrier body including a central bridge section 26 and container holders 28 pivotally mounted on the ends of the bridge section. The bridge section 26 serves as a handle or grip section for holding the carrier in the manner illustrated in FIG. 5. The carrier is preferably injection molded from a suitable plastic, such as polypropylene. Each container holder 28 is an annular collar including a ring 30 and a plurality of container neck-engaging elements 32 spaced circumferentially about the inner side of the ring. The carrier bridge section 26 has arcuate yoke arms 33 at its ends which straddle the adjacent container holders or collars 28. The free ends of these yoke arms are integrally joined to diametrically opposite sides of the adjacent container holders or collars 28 in a manner such that the collars have limited freedom of pivotal movement relative to the bridge section on parallel pivot axes transverse to the length of the bridge section and extending diametrically of the collars.

The carrier 12 is assembled on two containers 14 by pushing the carrier collars 28 downwardly over the container necks 18 to the assembled positions shown in FIGS. 1 and 4–6. In these positions, the collars 28 are located just below the container neck rings and container neck-engaging elements 32 of the collars engage the under sides of the container neck rings to vertically support the containers in the collars. The container package 10 is held by the carrier bridge section 26 in a normal position illustrated in FIG. 5. When thus held, the bridge section bends, and the carrier collars 28 pivot relative to the bridge section to prevent inadvertent separation of the collars from the containers, as described in my earlier mentioned copending application.

Figure 5:
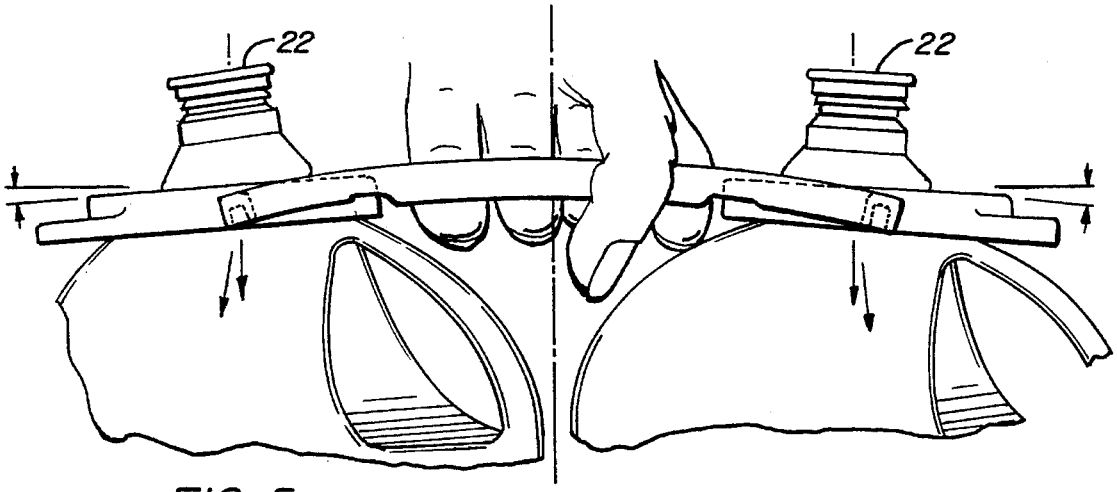
FIG. 5 is a view similar to FIG. 4 illustrating the manner in which the carrier bridge section bends and the container holders of the carrier pivot relative to the bridge section when the container package.
Figure 6:
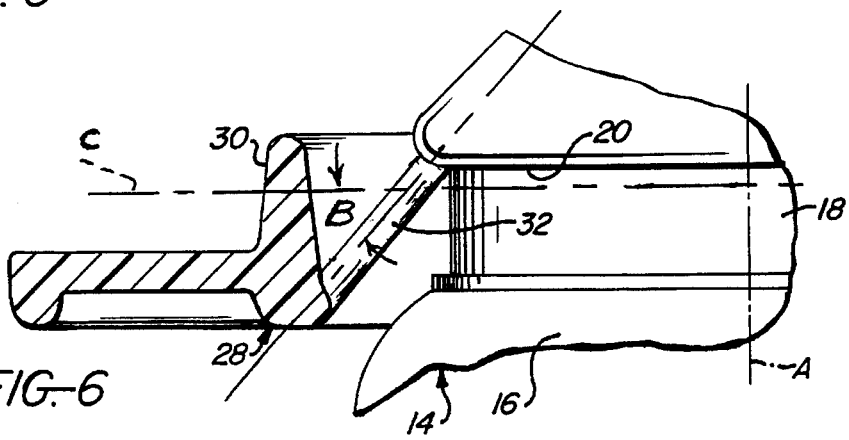
FIG. 6 is an enlargement of the area encircled by the arrow 6—6 in FIG. 4.

According to one improved feature of the present container carrier 26, the carrier bridge section 26 has reinforcing rib means 34 on its normally upper side for reinforcing this section against excessive bending when the container package 10 is held in the manner illustrated in FIG. 5, and the normally underside of the bridge section is made relatively flat and smooth. The bridge section has longitudinal edges and a longitudinal centerline midway between and parallel to these edges. The rib means 34 comprise a single upstanding rib 36 extending along the longitudinal centerline of the bridge section, upstanding flanges 38 along the longitudinal edges of the bridge section, and a cross rib joining the rib 36 and flanges 38 at their longitudinal centers.

This arrangement of the carrier 12 with the reinforcing rib means 34 located at the normally upper side of the bridge section 26 and the flat smooth side of the bridge section located at the normally underside of this section provides a three-fold advantage or benefit. First, with this arrangement, the bridge section 26 provides a relatively comfortable grip section by which the container package 10 may be comfortably held in the manner illustrated in FIG. 5. Secondly, during injection molding, the carrier 12 tends to warp in a manner which causes the molded carrier to assume a bowed or arch shape wherein the ends of the bridge section 26 curve away from the flat side of the bridge section and toward the ribbed side of the bridge section. Accordingly, with the described carrier arrangement wherein the rib means 34 are located at the normally upper side of the bridge section and its flat side is located at the normally underside of the bridge section, the curvature in the bridge section produced by warping of the carrier during molding is opposite to the bridge section curvature produced by the weight of the containers 14 when the container package 10 is held in the manner illustrated in FIG. 5. In other words, the bridge section curvature produced by warping of carrier during molding offsets or counteracts the bridge section curvature produced by the weight of the containers. Thirdly, because the reinforcing rib means 34 are located at the upper side of the bridge section 26, the rib means are stressed in tension, which is their strongest stess mode, during bending of the bridge section under the weight of the containers 14. The rib means thus provide optimum reinforcement of the bridge section 26 against bending under the container weight and they can be sized to provide just the right reinforcement for the carrier. The preferred carrier 12 illustrated has reinforcing beads 41 at its underside along its longitudinal edges to resist warping of the carrier during molding.

The preferred arrangement of the reinforcing rib means 34 is that illustrated and creates in the upper side of the bridge section 26 recesses or cavities 42 which are bounded by the edge flanges 38 and the rib 36 and open upwardly in the normal carrying position of the carrier 12. The liquid being handled may tend to collect in these cavities during handling of the container packages at the bottling plant where the containers are filled, during shipment of the container packages from the plant and/or during subsequent handling of the packages due, for example, to leakage in some container packages which are stacked one on top of the other. Collection of liquid in these cavities would be very undesireable and annoying to purchasers, particularly when the liquid is one, such as milk, which may breed bacteria or become sticky or unsightly. According to another important feature of the invention, the carrier bridge section 26 has drainage holes 44 opening to the cavities 42 through which liquid may drain from the cavities. The cavities may have any number of drainage holes, and these holes may be located anywhere in the cavities. The preferred carrier illustrated has a single drainage hole in each cavity. These holes are located at the outer ends of the cavities, that is the cavity ends nearest the ends of the bridge section 26, since any liquid in the cavities will accumulate in these cavity ends upon bending of the carrier bridge section 26 when the carrier package 10 is held as in FIG. 5.

The ring 30 of each container holder or collar 28 is a flexible, relatively thin-walled, generally cylindrical band. The container neck-engaging elements 32 of each collar are resiliently flexible fingers in the form of conically tapered webs which are integrally joined to the collar ring 30 and generally conically tapered about the axis of the ring. These container engaging fingers have a substantial width circumferentially of the ring 30 and together form, in effect, a resiliently flexible, radially split conical web. As shown best in FIG. 6, the fingers 32 of each container collar 28 extend from the collar ring 30 inwardly toward its axis A and upwardly toward the normally upper side of the carrier at an included angle B relative to a plane C transverse to the axis A. According to a preferred feature of this invention, the angle B is in the range of 30 to 45 degrees. This finger angle B provides two advantages over a smaller finger angle, namely easier placement of the carrier 12 on two containers 14 and increased container weight supporting capability. Thus, the carrier 12 is assembled on two containers 14 by pushing the carrier collars 28 downwardly over the container necks 18 to positions below the container neck rings 20, as shown best in FIG. 6. During this passage of the collars over the container necks, the container cap 22 and neck ring 20 deflect the collar fingers 32 upwardly and outwardly to permit passage of the container necks through the collars. Increasing the collar finger angle B to 30–45 degrees reduces the force required for this deflection of the fingers compared, for example, to a finger angle less than 30 degrees. Moreover, it will be observed in FIG. 6 that increasing the finger angle to 30–45 degrees increases the compression component and reduces the bending component of the force exerted on the collar fingers 32 by the containers and thereby increases the container weight supporting capability of the collars 28.

Figure 3A:
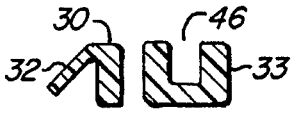
FIG. 3*a* is an enlarged section taken on line 3*a*–3*a* in FIG. 3.
Figure 3:
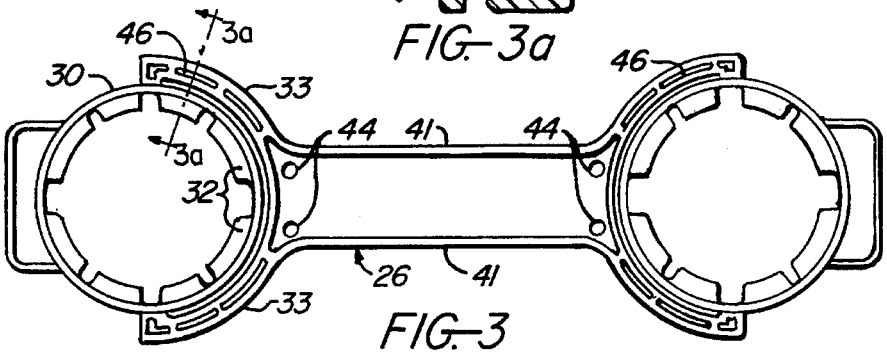
FIG. 3 is an enlarged bottom view of the container carrier in FIG. 1.
Figure 4:
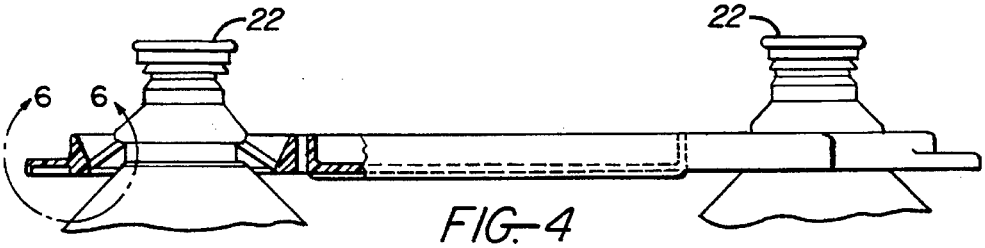
FIG. 4 is an enlarged fragmentary side elevation, partly broken away, of the upper portion of the container package in FIG. 1.

The single center longitudinal reinforcing rib 36 on the upper side of the carrier bridge section 26 constitutes another important feature of the invention. This single center rib design reinforces the bridge section against excessive bending while permitting sufficient bending of the bridge section to conform to the hand of a person holding the container package, as shown in FIG. 5, and thereby provide a comfortable handgrip for the carrier. According to another feature of the invention, the yoke arms 33 of the carrier bridge section 26 contain longitudinal channels or recesses 46 which open through the lower sides of the arms, as shown in FIG. 3*a*, to provide these arms with a channel-shaped cross-section which reduces the total volume of plastic material in the carrier.

What is claimed is:

1. A container carrier comprising:

a carrier body capable of being molded from plastic and including a pair of container holders for supporting a pair of containers, respectively, and a bridge section extending between and having ends joined to said holders, and wherein said bridge section is adapted to be grasped in one hand between said ends of the bridge section to hold the carrier in a normal carrying position wherein the end portions of said bridge section tend to bend downwardly under the weight of containers supported in said holders and thereby produce a curvature in said bridge section, and said bridge section includes a normally lower generally planar web portion extending longitudinally and laterally of the bridge section and having normally upper and lower sides, and upstanding reinforcing rib means on said upper side only of said web portion formed integrally with said web portion and extending longitudinally of the bridge section for reinforcing the bridge section against bending, whereby said bending of said bridge section is resisted by stressing of said reinforcing rib means in tension, and during molding of said carrier said plastic bridge section tends to warp in a manner which produces in the bridge section a curvature opposite to the bridge section curvature produced by bending of the bridge section under the weight of said containers.

2. A container carrier according to claim 1 wherein:

the underside of said bridge section is relatively flat and smooth.

3. A container carrier according to claim 1 wherein:

said rib means form upwardly opening cavities in the upper side of said bridge section in which liquid may collect, and said web portion of said bridge section has at least one liquid drainage hole for draining liquid from said cavities.

4. A container carrier according to claim 3 wherein:

each cavity has an end adjacent an end of said bridge section, whereby liquid in said cavities tends to accumulate in said cavity ends when said bridge section ends bend downwardly under the weight of containers supported in said holders, and said at least one drainage hole is located at a cavity end.

5. A carrier for containers of the kind having an upper reduced neck and a neck ring about said neck, said carrier comprising:

a carrier body having normally upper and lower sides and including a pair of container holders, and a bridge section extending between and having ends joined to said holders and adapted to be grasped between said ends for holding said carrier in a normal position wherein the weight of containers supported in said holders tends to bend the bridge section ends downwardly, and wherein said bridge section has a normally upper side at said upper side of said body, reinforcing rib means at said upper side of the bridge section for reinforcing the bridge section against bending and forming upwardly opening cavities in said upper side of the bridge section, and at least one drainage hole for draining liquid from said cavities, each container holder comprises a collar for engagement over a container neck and including a flexible annular collar ring having a central axis normal to said body sides, and resiliently flexible container-engaging fingers spaced about the inner circumference of and joined to said collar ring and extending inwardly from said collar ring toward said ring axis and upwardly toward the upper side of the carrier body at an included angle in range of 30–45 degrees relative to a plane transverse to said axis, each collar is engagable over a container neck to a position below said neck ring wherein said fingers engage the container neck below said neck ring and the underside of said neck ring to vertically support the container in the collar, said bridge section has a relatively smooth and flat under side, longitudinal edges, and a longitudinal centerline parallel to and midway between said edges, said reinforcing rib means comprise upstanding flanges along said longitudinal edges of said bridge section and an upstanding reinforcing rib along said longitudinal centerline, each cavity is located adjacent one of said bridge section ends and has a cavity end adjacent the respective bridge section end, said at least one drainage hole is located at a cavity end, and said collar fingers comprise generally conically tapered webs.

6. A container carrier according to claim 5 wherein:

said bridge section has fork arms at each end straddling the adjacent collar and pivotally joined to the respective collar ring on a pivot axis parallel to said carrier body sides and extending diametrically of the respective collar ring and transverse to said bridge section, and said fork arms have a channel-shaped cross-section.

* * * * *